US007731548B2

(12) United States Patent
Yoshida

(10) Patent No.: US 7,731,548 B2
(45) Date of Patent: Jun. 8, 2010

(54) COAXIAL CONNECTOR AND A STRUCTURE FOR ATTACHING THE COAXIAL CONNECTOR TO A CONNECTOR HOUSING

(75) Inventor: Norihito Yoshida, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 189 days.

(21) Appl. No.: 11/920,718

(22) PCT Filed: Jun. 9, 2006

(86) PCT No.: PCT/JP2006/311611

§ 371 (c)(1),
(2), (4) Date: Dec. 10, 2007

(87) PCT Pub. No.: WO2006/132358

PCT Pub. Date: Dec. 14, 2006

(65) Prior Publication Data

US 2009/0247009 A1 Oct. 1, 2009

(30) Foreign Application Priority Data

Jun. 9, 2005 (JP) ..... 2005-169715

(51) Int. Cl.
*H01R 13/514* (2006.01)

(52) U.S. Cl. ..... 439/752.5; 439/578

(58) Field of Classification Search ..... 439/752.5, 439/595, 578, 752, 99
See application file for complete search history.

(56) References Cited

U.S. PATENT DOCUMENTS

| | | | | |
|---|---|---|---|---|
| 4,990,104 | A * | 2/1991 | Schieferly | 439/578 |
| 6,846,195 | B2 * | 1/2005 | Annequin | 439/352 |
| 6,951,483 | B2 * | 10/2005 | Kameyama | 439/595 |
| 2004/0192119 | A1 * | 9/2004 | Sakurai et al. | 439/752.5 |
| 2005/0181664 | A1 * | 8/2005 | Fukuzaki et al. | 439/521 |

FOREIGN PATENT DOCUMENTS

| | | |
|---|---|---|
| JP | U 4-87185 | 7/1992 |
| JP | U 5-45963 | 6/1993 |
| JP | A 2000-156261 | 6/2000 |
| JP | A 2000-188157 | 7/2000 |
| JP | A 2000-208214 | 7/2000 |
| JP | A 2001-155822 | 6/2001 |
| JP | A 2003-151670 | 5/2003 |
| JP | A 2003-257560 | 9/2003 |

* cited by examiner

*Primary Examiner*—Gary F. Paumen
(74) *Attorney, Agent, or Firm*—Oliff & Berridge PLC

(57) ABSTRACT

A coaxial connector having excellent shielding performance. The coaxial connector 30 includes a coaxial cable 12, an outer conductor terminal 32 connected to a top end of the coaxial cable 12, an opening portion 34, stabilizers 36, and an engaging piece 44. The opening portion 34 locks a locking piece of a connector housing used to house the coaxial connector 30, the stabilizers 36 control an insertion orientation of the coaxial connector 30 into the housing, the engaging piece 44 engages with the locking piece, and they are provided on a peripheral surface at a main section of the outer conductor terminal 32. The opening portion 34 is closed by a main section of an outer conductor terminal of a counterpart coaxial connector when the connectors are mated. The engaging piece 44 functions as a guide plane when the stabilizers 36 are inserted into a slit of the housing.

10 Claims, 12 Drawing Sheets

COAXIAL CONNECTOR AND A STRUCTURE FOR ATTACHING THE COAXIAL CONNECTOR TO A CONNECTOR HOUSING

TECHNICAL FIELD

The present invention relates to a coaxial connector and a structure for attaching the coaxial connector to a connector housing, and more specifically relates to a coaxial connector having excellent shielding performance and a structure for attaching the coaxial connector to a connector housing.

BACKGROUND ART

Generally, electric connection of coaxial cables to be routed through electric or other equipment to be mounted inside an automobile is obtained by attaching a coaxial connector at a top end of the coaxial wire, housing the coaxial connector in a connector housing, and coupling the connector housing to a counterpart coaxial connector.

The connector housing includes an attaching portion (cavity) for the coaxial connector, and a locking piece provided to the attaching portion (cavity). The locking piece enables the coaxial connector to be attached thereto removably. The coaxial connector is inserted into and slid in the connector housing so as to be attached to the connector housing.

In response to higher frequency and speed of electric signals which are transmitted to the electric or other equipment mounted inside the automobile in these years, a cross-sectional shape of the coaxial connector is arranged to be a circular shape the same as a cross-sectional shape of the coaxial cables so as not to vary a coaxial structure of the coaxial cables as much as possible.

In such a case, the coaxial connector can be turned in 360 degrees when inserted into the connector housing, therefore, required especially is a stabilizer arranged to determine an orientation to insert the coaxial connector into the connector housing (i.e., to control an insertion orientation).

FIGS. 11A and 11B show a structure of a conventional coaxial connector (see Japanese Patent Application Unexamined Publication No. 2000-188157). An outer conductor terminal 72 of a coaxial connector 70 is a member prepared by die-cutting a plate material or other materials and forming the die-cut material into a cylindrical shape or other shapes. The outer conductor terminal 72 is configured to include an opening portion 74 arranged to lock a locking piece of a connector housing, stabilizers 76 arranged to determine (control) an insertion orientation of the coaxial connector 70 into the connector housing, a juncture (fitting portion) 78 at butted edges of the material, spring pieces 80 arranged to apply contact load to the outer conductor terminal 72 and a counterpart outer conductor terminal during their connection so as to secure electric connection therebetween, and a protective portion 82 arranged to cover top edges of the spring pieces 80 so that the spring pieces 80 may not be broken by colliding against foreign substances. The stabilizers 76 are, for example, formed by cutting and erecting a peripheral surface at a main section of the outer conductor terminal 72.

DISCLOSURE OF THE INVENTION

Problem to be Solved by the Invention

However, Japanese Patent Application Unexamined Publication No. 2000-188157 presents such a problem that shielding performance of the coaxial connector is not sufficiently obtained since the portion 74 arranged to lock the locking piece of the connector housing is made open as shown in FIGS. 11A and 11B. Considered is covering the opening portion 74 with a shielding plate or other members, which, however, causes an increase in the number of components or an increase in the number of manufacturing processes.

In addition, an opening portion is made also when the stabilizers 76 arranged to determine the insertion orientation of the coaxial connector 70 into the connector housing are formed (in FIGS. 11A and 11B, and this opening portion is used as the opening portion 74 arranged to lock the locking piece), therefore, there also arises a problem that shielding performance is lowered.

An object of the present invention is to overcome the problems described above and to provide a coaxial connector having excellent shielding performance and a structure for attaching the coaxial connector to a connector housing.

Means for Solving Problem

To achieve the objects and in accordance with the purpose of the present invention, as described in claim 1, a structure for attaching a coaxial connector to a connector housing, in which an outer conductor terminal of a first coaxial connector is connected to a top end of a coaxial cable, an outer conductor terminal of a second coaxial connector is connected to a top end of a coaxial cable, and the outer conductor terminals are mated in the connector housing, is characterized in that an opening portion provided on an outer surface at a main section of the outer conductor terminal of the first coaxial connector and arranged to lock a locking piece of the connector housing is closed by a main section of the outer conductor terminal of the second coaxial connector.

As described in claim 2, a coaxial connector according to the present invention is characterized as including a coaxial cable, an outer conductor terminal connected to a top end of the coaxial cable, and an opening portion provided on a peripheral surface at a main section of the outer conductor terminal, at which section an outer conductor terminal of a counterpart coaxial connector is positioned, and arranged to lock a locking piece of a connector housing used to house the coaxial connector.

As described in claim 3, it is preferable that the coaxial connector further includes a fitting portion provided at the main section of the outer conductor terminal by bending a metal plate to have a cylindrical shape and butting and fitting edges of the metal plate, and the opening portion arranged to lock the locking piece is placed at a position different from that of the fitting portion.

As described in claim 4, it is preferable that the coaxial connector further includes an engaging piece provided at an edge of the opening portion provided at the main section of the outer conductor terminal, formed so as to project outward from the peripheral surface at the main section of the outer conductor terminal, and arranged to engage with the locking piece of the connector housing.

As described in claim 5, a coaxial connector according to the present invention is characterized as including a coaxial cable, an outer conductor terminal connected to a top end of the coaxial cable, and a stabilizer formed by cutting and erecting a peripheral surface at a main section of the outer conductor terminal, at which section an outer conductor terminal of a counterpart coaxial connector is positioned, and arranged to control an insertion orientation of the coaxial connector into a slit of a connector housing used to house the coaxial connector.

As described in claim 6, it is desirable that the coaxial connector further includes an opening portion made by forming the stabilizer, and the opening portion is used as an opening portion arranged to lock a locking piece of the connector housing.

As described in claim 7, it is desirable that the coaxial connector further includes an engaging piece provided at an edge of the opening portion made by forming the stabilizer, formed so as to project outward from the peripheral surface at the main section of the outer conductor terminal, and arranged to engage with the locking piece of the connector housing.

As described in claim 8, it is preferable that the coaxial connector further includes a guide piece provided at the edge of the opening portion made by forming the stabilizer, formed so as to project outward from the peripheral surface at the main section of the outer conductor terminal, and arranged to function as a guide plane when the stabilizer is inserted into the slit of the connector housing.

As described in claim 9, it is desirable that the guide piece arranged to function as the guide plane when the stabilizer is inserted into the slit is used as the engaging piece arranged to engage with the locking piece of the connector housing.

As described in claim 10, an outer surface of the engaging piece arranged to engage with the locking piece of the connector housing has a curved plane so as to be smooth.

Effect of the Invention

According to the invention described in claim 1, since the opening portion provided at the main section of the outer conductor terminal of the coaxial cable and arranged to lock the locking piece is closed by the main section of the outer conductor terminal of the other coaxial cable when the female and male coaxial connectors are mated and connected, a coaxial structure of the coaxial cables is maintained also in the coaxial connectors, therefore, shielding performance is not lowered.

According to the invention described in claim 2, since the opening portion arranged to lock the locking piece of the connector housing is placed on the peripheral surface at the main section of the outer conductor terminal of the coaxial connector, at which section the outer conductor terminal of the counterpart coaxial connector is positioned, the opening portion is closed by the main section of the counterpart outer conductor terminal when the coaxial connectors are mated so as to obtain electric connection of the coaxial cables. Therefore, shielding properties are not lowered, and excellent shielding performance is obtained.

In this case, by placing the opening portion at the different position from that of the fitting portion at the butted edges of the outer conductor terminal, the locking piece of the connector housing does not overpass the fitting portion when the coaxial connector is inserted into and attached to the connector housing, so that the locking piece is not worn and broken by unevenness of the fitting portion, and a force of the locking piece to hold the coaxial connector is not lowered by repeating insertion and removal of the coaxial connector.

In addition, by forming the engaging piece so as to project at the edge of the opening portion at the main section of the outer conductor terminal, the engaging piece functions as a projection arranged to lock the locking piece of the connector housing so as to firmly engage with the locking piece and enhance a locking force of the locking piece, so that a force of the connector housing to hold the coaxial connector can be increased.

According to the invention described in claim 5, since the stabilizer to be inserted into the slit of the connector housing is formed by cutting and erecting the peripheral surface at the main section of the outer conductor terminal of the coaxial connector, at which section the outer conductor terminal of the counterpart coaxial connector is positioned, the opening portion made by forming the stabilizer is closed by the main section of the counterpart outer conductor terminal when the coaxial connectors are mated so as to obtain electric connection of the coaxial cables, therefore, shielding properties of the coaxial connector are not lowered, and excellent shielding performance is obtained.

In this case, by using the opening portion made by forming the stabilizer as the opening portion arranged to lock the locking piece of the connector housing, a process of independently providing the opening portion arranged to lock the locking piece at the main section of the outer conductor terminal becomes unnecessary, so that the number of manufacturing processes can be decreased.

In addition, by forming the engaging piece so as to project at the edge of the opening piece made by forming the stabilizer, the engaging piece functions as a projection arranged to lock the locking piece of the connector housing so as to firmly engage with the locking piece and enhance the locking force of the locking piece, so that the force of the connector housing to hold the coaxial connector can be increased.

Besides, by forming the guide piece so as to project at the edge of the opening portion made by forming the stabilizer, the guide piece functions as the guide plane when the stabilizer of the outer conductor terminal of the coaxial connector is inserted into the slit, therefore, the coaxial connector can be easily inserted into the connector housing.

In addition, by using the guide piece as the engaging piece arranged to engage with the locking piece of the connector housing, the process of forming the engaging piece and the process of forming the guide piece can be integrated, so that the number of manufacturing processes can be decreased, and the coaxial connector can be provided with favorable locking force and insertability.

Further, by providing the outer surface of the engaging piece arranged to engage with the locking piece of the connector housing with a curved plane so as to be a smooth smooth, the locking piece is not chipped off when the locking piece makes contact with and is caught onto the engaging piece of the outer conductor terminal in the process of inserting the coaxial connector into the connector housing, so that the force of the connector housing to hold the coaxial connector is not lowered if insertion and removal of the coaxial connector are repeated.

BEST MODE FOR CARRYING OUT THE INVENTION

Detailed descriptions of preferred embodiments of the present invention will now be given with reference to FIGS. 1A to 10.

Figure 1A:
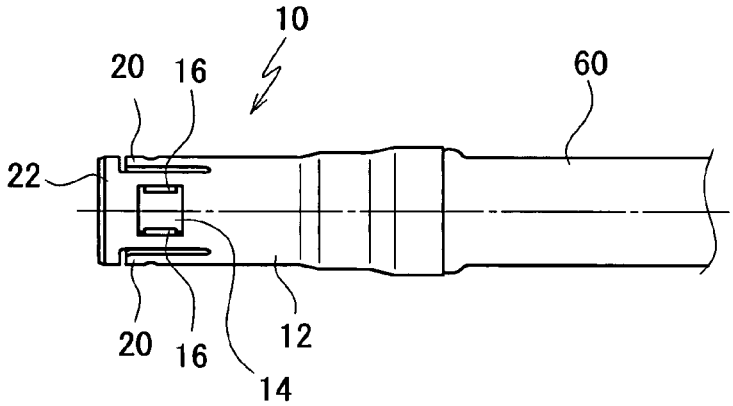
FIGS. 1A to 1C are views showing a structure of a coaxial connector according to a first preferred embodiment of the present invention.
Figure 1B:
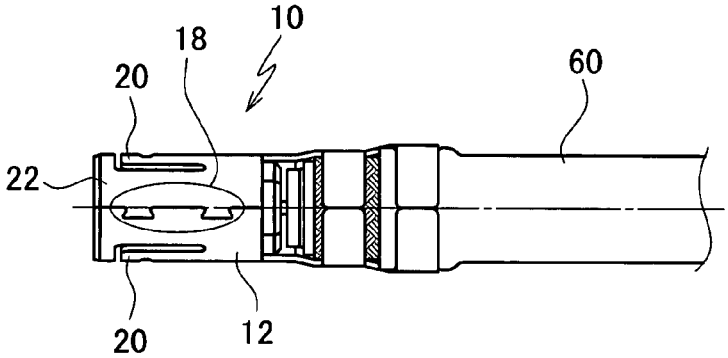
Figure 1C:
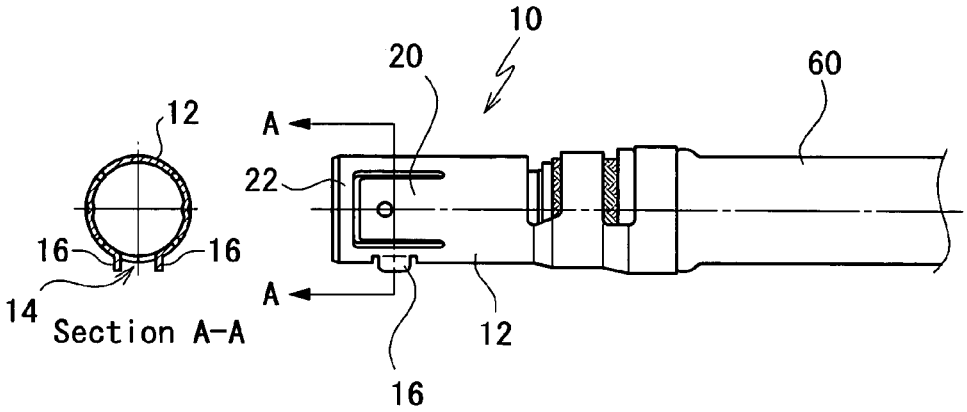

FIGS. 1A to 1C are views showing a coaxial connector 10 as a female coaxial connector according to the first preferred embodiment of the present invention. FIG. 1A is a bottom view of the coaxial connector 10, FIG. 1B is a top view thereof, and FIG. 1C is a side view thereof.

Figure 10:
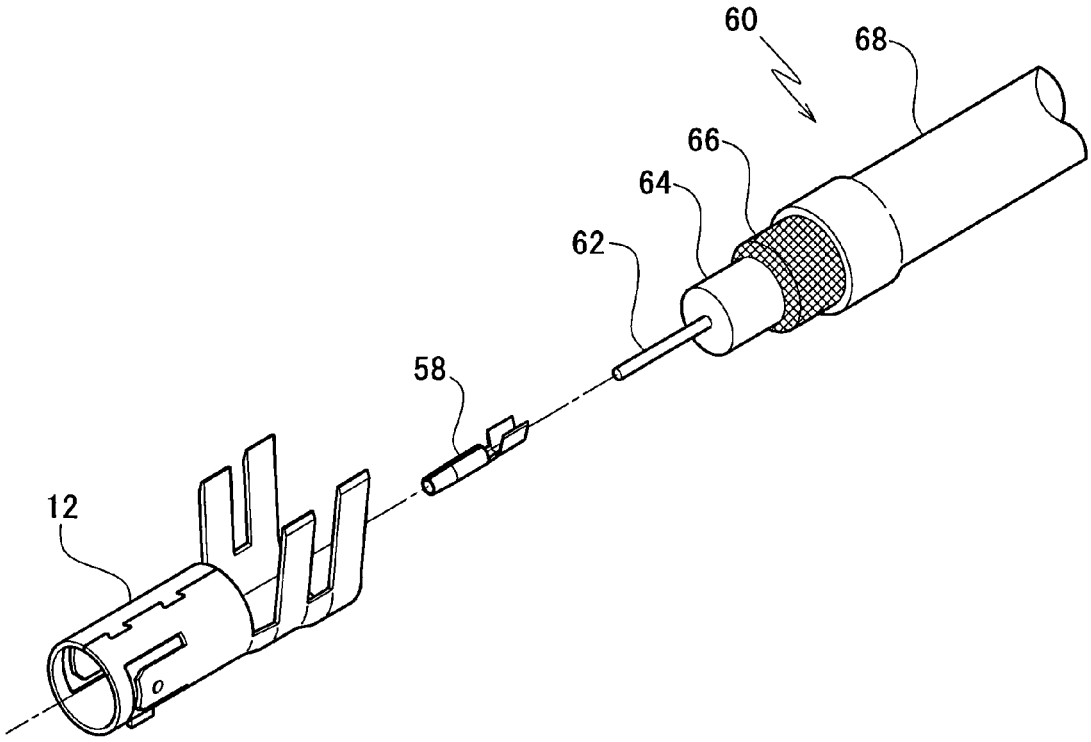
FIG. 10 is a view showing a structure of a common coaxial cable.

As shown in FIG. 10, the coaxial connector 10 includes a coaxial cable 60, an inner conductor terminal 58, and an outer conductor terminal 12. The coaxial cable 60 includes a signal conductor 62, an insulation 64 provided around the signal conductor 62, a shielded conductor 66 made of a braid and provided around the insulation 64, and a sheath 68 provided around the shielded conductor 66. At an end portion of the coaxial cable 60, the insulation 64, the shielded conductor 66 and the sheath 68 are stripped off stepwise. The inner conductor terminal 58 and the outer conductor terminal 12 are respectively crimped onto and connected to the signal conductor 62 and the shielded conductor 66.

As shown in FIGS. 1A to 1C, the outer conductor terminal 12 of the coaxial connector 10 includes an opening portion 14 and stabilizers 16 at its bottom section, a fitting portion 18 at its top section, spring pieces 20 at its side sections, and a protective portion 22 on the top end side relative to the spring pieces 20.

The outer conductor terminal 12 may be prepared by die-cutting a metal plate material and bending the die-cut plate material so as to have a cylindrical shape. The shape may be a circular cylindrical shape or a rectangular cylindrical shape, and is not limited in particular. If there occurs a gap at the juncture of butted edges of the plate material, reaction force of the spring pieces 20 provided at a top end section of the outer conductor terminal 12 is reduced, so that contact load between the outer conductor terminal 12 and a counterpart outer conductor terminal to be mated thereto is reduced, whereby there is a possibility that contact resistance between the outer conductor terminals at their mating section is increased, so that designated capabilities cannot be obtained. Therefore, it is preferable that one of the edges includes convex portions, the other one includes concave portions, and both the edges are butted, so that no gap occurs at the juncture of the butted edges.

The opening portion 14 is provided on a peripheral surface at a main section of the outer conductor terminal 12. The opening portion 14 is arranged to take in and lock a locking piece of a connector housing to be described later so as to fix the coaxial connector 10 to the connector housing. The opening portion 14 may be placed at any position at the main section of the outer conductor terminal 12. The main section refers to a mating section at which electric connection is made mainly by mating the outer conductor terminals, at which section the opening portion 14 is positioned on a peripheral surface of the counterpart outer conductor terminal when the outer conductor terminals are mated.

The stabilizers 16 are, for example, members prepared by cutting and erecting the peripheral surface at the main section of the outer conductor terminal 12. In order to smoothly inserting the coaxial connector 10 into the connector housing, the stabilizers 16 are preferably cut and erected into a direction perpendicular to an insertion direction of the coaxial connector 10.

By forming the stabilizers 16, an opening portion is made on the peripheral surface at the main section of the outer conductor terminal 12, and this opening portion may be used as the opening portion 14. By doing so, the process of forming the opening portion 14 arranged to lock the locking piece of the connector housing and the process of forming the stabilizers 16 can be integrated, so that there is an advantage of decreasing the number of manufacturing processes.

It is also preferable that an opening portion 14 and stabilizers 16 are independently formed at separate positions on the peripheral surface at the main section of the outer conductor terminal 12. In this case, it is preferable that an opening portion made by forming the stabilizers 16 is also provided at the main section of the outer conductor terminal 12 because the opening portion is closed when the outer conductor terminals are mated.

It is preferable that as shown in FIG. 1B, the opening portion 14 arranged to lock the locking piece of the connector housing is placed at a position different from that of the fitting portion 18 which is provided when the outer conductor terminal 12 is manufactured. Placing the opening portion 14 at the different position is, in other words, not placing the opening portion 14 at an extension of the fitting portion 18, for example, placing the opening portion 14 at a position such that the locking piece to be taken in by the opening portion 14 does not overpass the fitting portion 18 when the coaxial connector 10 is inserted into the connector housing. This is for the purpose of preventing the locking piece from being chipped off by rubbing of the fitting portion 18 and the locking piece against each other.

The spring pieces 20 are, for example, prepared by making one or more cuts in a top end section of the outer conductor terminal 12. The spring pieces 20 are pulled outward or inward in a cross-sectional direction of the outer conductor terminal 12 when the outer conductor terminals are mated, and accordingly, contact load during their mating is secured and electric connection reliability is enhanced.

It is preferable to provide the protective portion 22 on the top end side relative to the spring pieces 20 because there is a possibility that the spring pieces 20 collide against foreign substances and are broken not only when inserting the coaxial connector 10 into the connector housing but also when handling the outer conductor terminal 12.

A cross-sectional view in section A-A of FIG. 1C shows a cross-sectional shape at the main section of the outer conductor terminal 12. As illustrated, the outer conductor terminal 12 is circular in cross section, and the opening portion 14 and the stabilizers 16 are provided at the bottom section of the outer conductor terminal 12. The stabilizers 16 extend downward in FIG. 1C, and when the outer conductor terminal 12 is inserted into the connector housing to be described later, the stabilizers 16 are set in a slit formed at a bottom section of a cavity of the connector housing, whereby an insertion orientation is controlled.

Figure 2A:
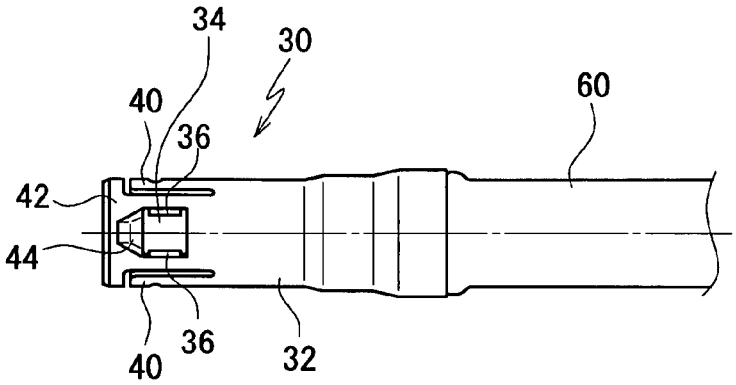
FIGS. 2A to 2C are views showing a structure of a coaxial connector according to a second preferred embodiment of the present invention.
Figure 2B:
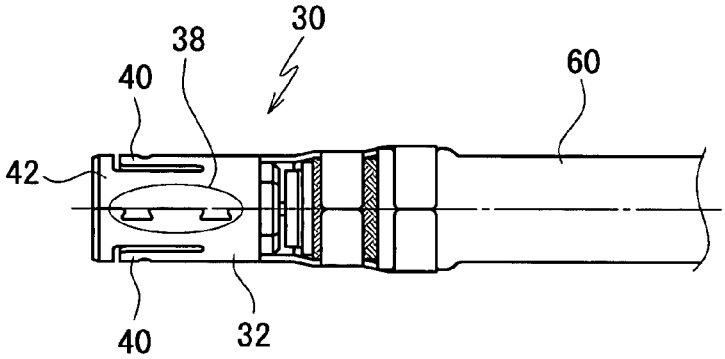
Figure 2C:
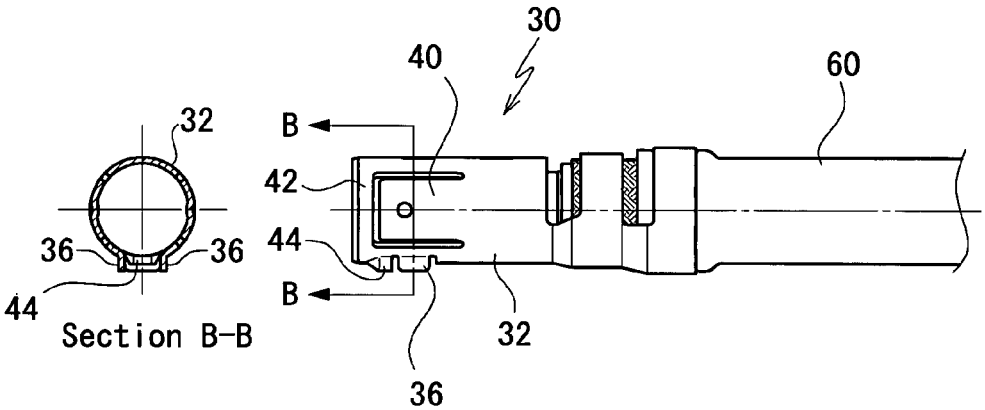

FIGS. 2A to 2C are views showing a coaxial connector 30 according to the second preferred embodiment of the present invention, where the coaxial connector 30 is a female coaxial connector as in the case of the first preferred embodiment. FIG. 2A is a bottom view of the coaxial connector 30, FIG. 2B is a top view thereof, and FIG. 2C is a side view thereof.

As shown in FIGS. 2A to 2C, an outer conductor terminal 32 includes an opening portion 34, stabilizers 36, and an engaging piece 44 at its bottom section, a fitting portion 38 at its top section, spring pieces 40 at its side sections, and a protective portion 42 on the top end side relative to the spring pieces 40. The opening portion 34 are arranged to lock the locking piece, the stabilizers 36 are arranged to control an insertion orientation of the coaxial connector 30 into the connector housing, and the engaging piece 44 are arranged to enhance a locking force of the locking piece.

Similar to the outer conductor terminal 12 of the coaxial connector 10 shown in FIGS. 1A to 1C, an opening portion made on a peripheral surface at a main section of the outer conductor terminal 32 by forming the stabilizers 36 may be used as the opening portion 34 arranged to lock the locking piece. Alternatively, an opening portion 34 and stabilizers 36 may be independently provided at separate positions on the peripheral surface at the main section of the outer conductor terminal 32.

In comparison with the outer conductor terminal 12 of the coaxial connector 10 shown in FIGS. 1A to 1C, the outer conductor terminal 32 of the coaxial connector 30 additionally includes the engaging piece 44. As described later, the engaging piece 44 is arranged so that the locking piece, which is taken in by the opening portion 34 when the coaxial connector 30 is inserted into the connector housing, holds the outer conductor terminal 32 more firmly, and the engaging piece 44 engages with the locking piece.

The engaging piece 44 enhances the locking force of the locking piece when the coaxial connector 30 is inserted into the connector housing. Therefore, it is not necessary that the opening portion 34, which is provided at the main section of the outer conductor terminal 32 of the coaxial connector 30, deeply takes in the locking piece in order to enhance the locking force of the locking piece. In addition, the engaging piece 44 prevents the counterpart outer conductor terminal to close the opening portion 34 from making contact with the locking piece during mating of the coaxial connector 30 and the counterpart coaxial connector.

During the insertion of the coaxial connector 30 into the connector housing, the engaging piece 44 may also function as a guide plane in inserting the stabilizers 36 into the slit of the connector housing. Insertability of the stabilizers 36 into the slit can be thereby improved. In addition to the engaging piece 44, there may be provided a guide piece which functions as such a guide plane that improves insertability of the stabilizers 36 into the slit. In the case of providing the additional guide piece, it is preferably placed at a position on the top end side relative to the stabilizers 36. In this case, the position of the engaging piece 44 is arranged to be different from that of the guide piece.

It is preferable that a portion of the engaging piece 44 to be brought into contact with the locking piece at the time of the insertion of the coaxial connector 30 into the connector housing is made smooth. For example, an outer surface of the engaging piece 44 is arranged to have a curved plane. This is for the purpose of preventing the locking piece from being chipped off by the engaging piece 44 at the time of their contact.

A cross-sectional view in B-B section of FIG. 2C shows a cross-sectional shape at the main section of the outer conductor terminal 32. As illustrated, the outer conductor terminal 32 is circular in cross section, and the opening portion and the stabilizers 36 are placed at the bottom section of the outer conductor terminal 32, and the engaging piece 44 is placed in the back portion. The stabilizers 36 extend downward in FIG. 2C, and when the outer conductor terminal 32 is inserted into the connector housing to be described later, the stabilizers 36 are set in the slit positioned at the bottom section of the cavity of the connector housing, whereby the insertion orientation is controlled. After the outer conductor terminal 32 reaches the locking piece of the connector housing, the locking piece overpasses the engaging piece 44 so as to be taken in by the opening portion.

Figure 3A:
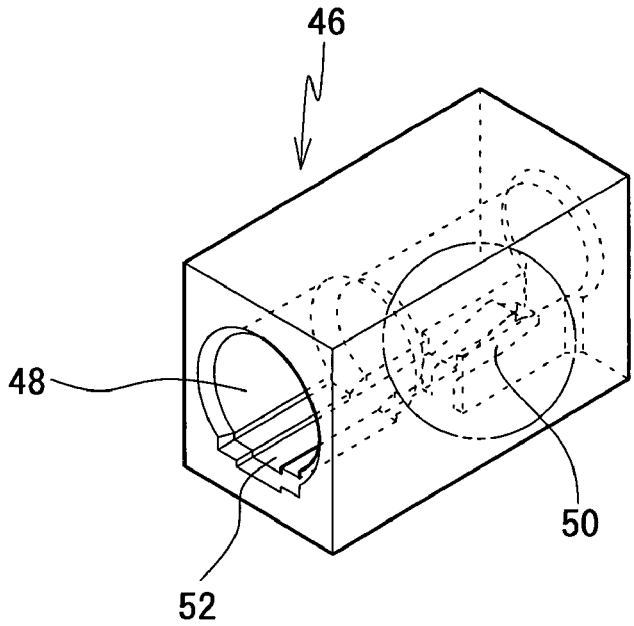
FIGS. 3A and 3B are views showing an example of a structure of a connector housing.

FIG. 3A shows a connector housing 46. The connector housing 46 includes a cavity 48 at its center section and a slit 52 at its bottom section. The cavity is arranged to house the coaxial connector. The slit 52 is arranged to allow the insertion of the stabilizers so as to control the insertion orientation of the coaxial connector. An extension of the slit 52 includes a locking piece 50 arranged to lock the outer conductor terminal of the coaxial connector.

Figure 3B:
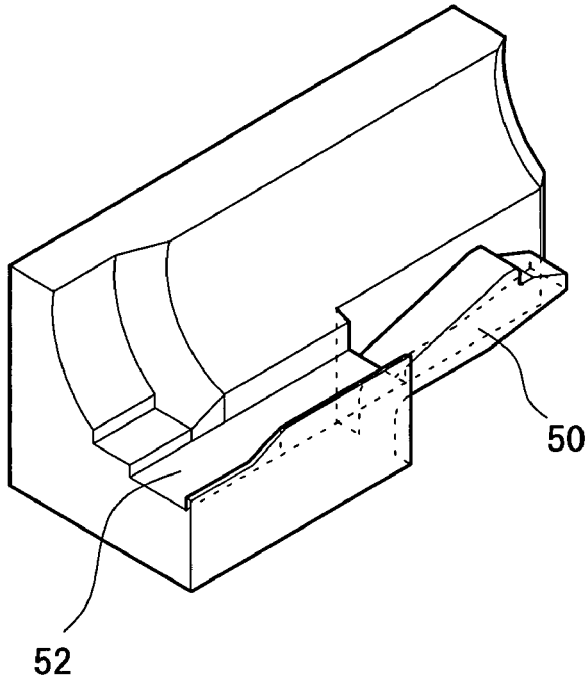

A detailed description of the interior of the connector housing 46 will be given with reference to FIG. 3B. On both sides of the locking piece 50 placed at the back of the slit 52, there are provided gaps through which the stabilizers entering the connector housing 46 with its insertion orientation being controlled pass, and when the stabilizers reach the locking piece 50, they are housed in the gaps on the both sides of the locking piece 50.

Next, a description of attachment of the coaxial connector to the connector housing will be given.

Figure 4:
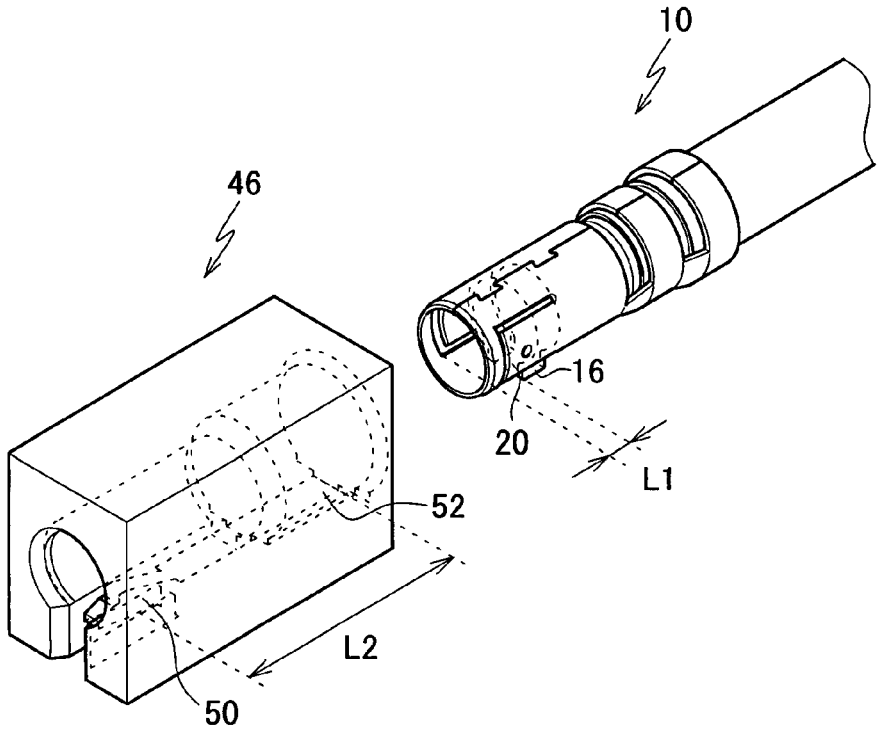
FIG. 4 is a view showing a state before the coaxial connector shown in FIGS. 1A to 1C is attached to the connector housing shown in FIGS. 3A and 3B.

FIG. 4 is a view showing a state before the coaxial connector 10 is inserted into the connector housing 46. It is preferable that a length L1 between the top edge of the spring pieces 20 and the top side edge of the stabilizers 16 in the coaxial connector 10 is shorter than a length L2 between the starting position of the slit 52 and the base position of the locking piece 50 in the connector housing 46. This is because in the process of inserting the coaxial connector 10 into the connector housing 46, it is desirable that the spring pieces 20 have yet to reach the locking piece 50 when the control of the insertion orientation starts to be exerted on the coaxial connector 10 (when the stabilizers 16 are inserted into the slit 52). Since the spring pieces 20 have yet to reach the locking piece 50 at the time, the locking piece 50 is not taken in by the spring pieces 20 even if the insertion orientation is improper, so that the spring pieces 20 are free from damage.

Figure 5:
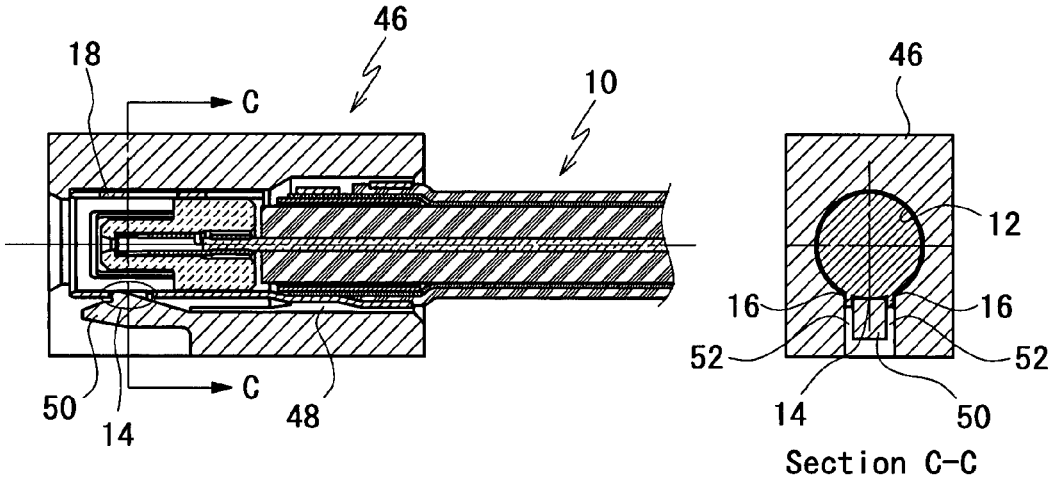
FIG. 5 is a view showing a state in which the coaxial connector shown in FIGS. 1A to 1C is attached to the connector housing shown in FIGS. 3A and 3B.

FIG. 5 is a view showing a state in which the coaxial connector 10 is inserted into and attached to the connector housing 46, and a cross-sectional view in section C-C of FIG. 5 shows a positional relationship between the locking piece 50 and the stabilizers 16. The coaxial connector 10 is locked and fixed by the locking piece 50 which is taken in by the opening portion 14 of the outer conductor terminal 12. The stabilizers 16 arranged to control the insertion orientation are set in the gaps on the both sides of the locking piece 50.

Figure 12:
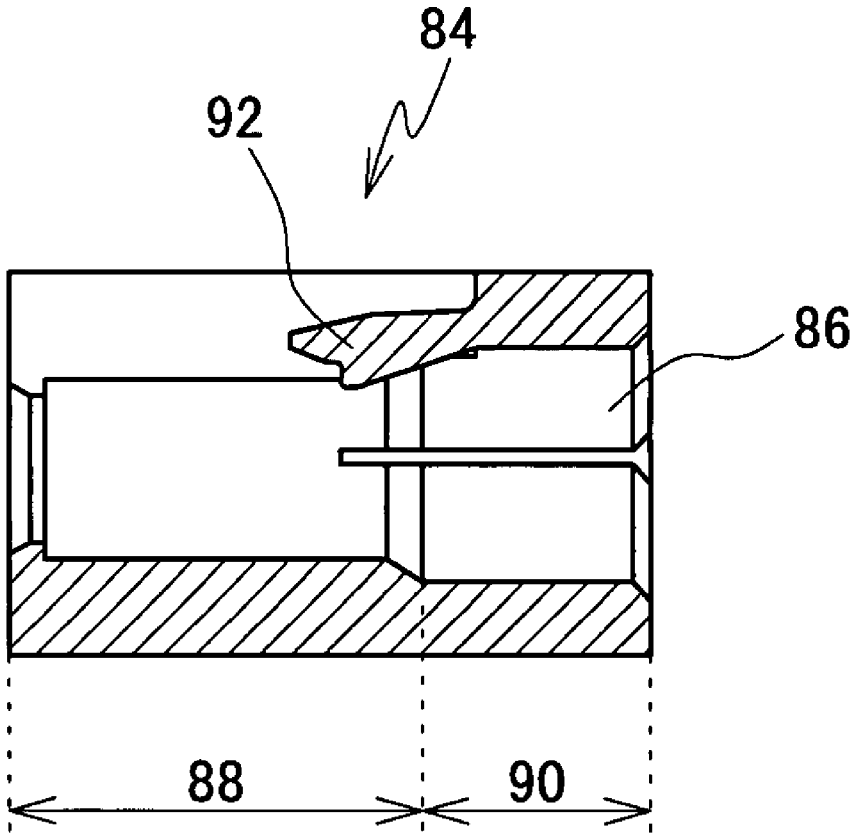
FIG. 12 is a view showing an example of a structure of a connector housing having a cavity of two-level cylindrical shape.

Since the height of the stabilizers 16 does not exceed the height of the locking piece 50 toward a bottom section of the connector housing 46, the coaxial connector 10 is not increased in size toward the bottom section of the connector housing 46 beyond a space to accommodate the locking piece 50. In contrast, in the conventional coaxial connector, slits are provided on side surfaces or at other positions inside a connector housing 84 as shown in FIG. 12, so that the coaxial connector is increased in size in side-surface directions or other directions.

Figure 14A:
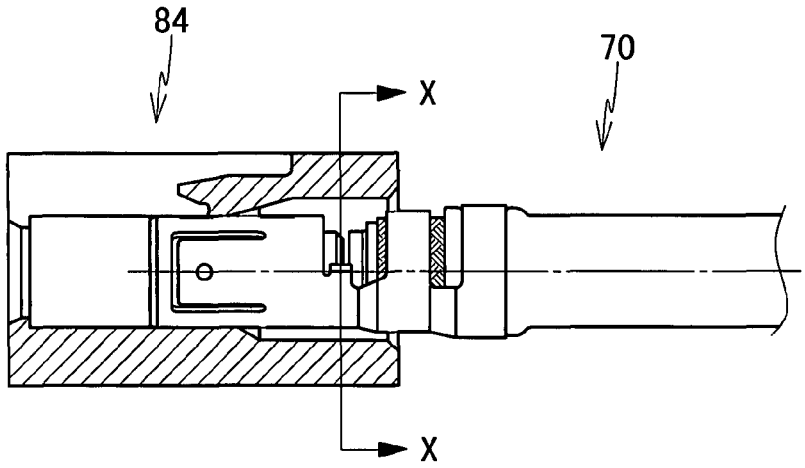
FIGS. 14A to 14C are cross-sectional views showing a state in which the coaxial connector shown in FIGS. 11A and 11B is in the process of being inserted into the connector housing shown in FIG. 12.
Figure 14B:
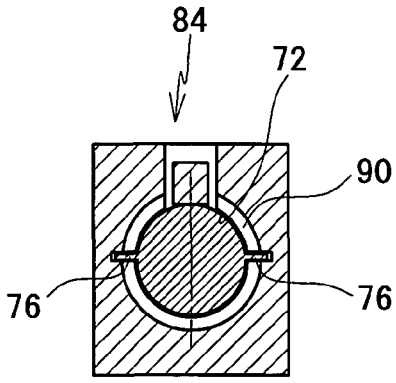
Figure 14C:
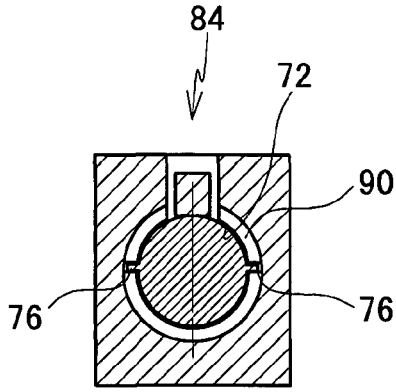

For example, in a case where a decrease in the size of a coaxial connector is to be achieved in need of a routing space of coaxial cables or for other reasons, a connector housing is configured to include a cavity of two-level cylindrical shape (the diameter of the cavity is larger in an entrance portion and smaller in a back portion) in order to conform to the decrease in the size of the coaxial connector in circular cylindrical shape. FIGS. 14B and 14C are cross-sectional views in X-X section of FIG. 14A, in which positional relationships between a cavity 86 and stabilizers 76 in the process of inserting a coaxial connector 70 into the connector housing 84 (see FIG. 14A) are illustrated. Conventionally, when it is intended that the stabilizers 76 have their insertion orientation controlled in a larger-diameter portion (entrance portion) 90 of the cavity 86, it is necessary to make the stabilizers 76 extend beyond the larger-diameter portion 90 as shown in FIG. 14B. In this case, even if the size of the coaxial connector is decreased, the size of the connector housing cannot be decreased, therefore, decreases in the sizes of the whole are not achieved.

Figure 15:
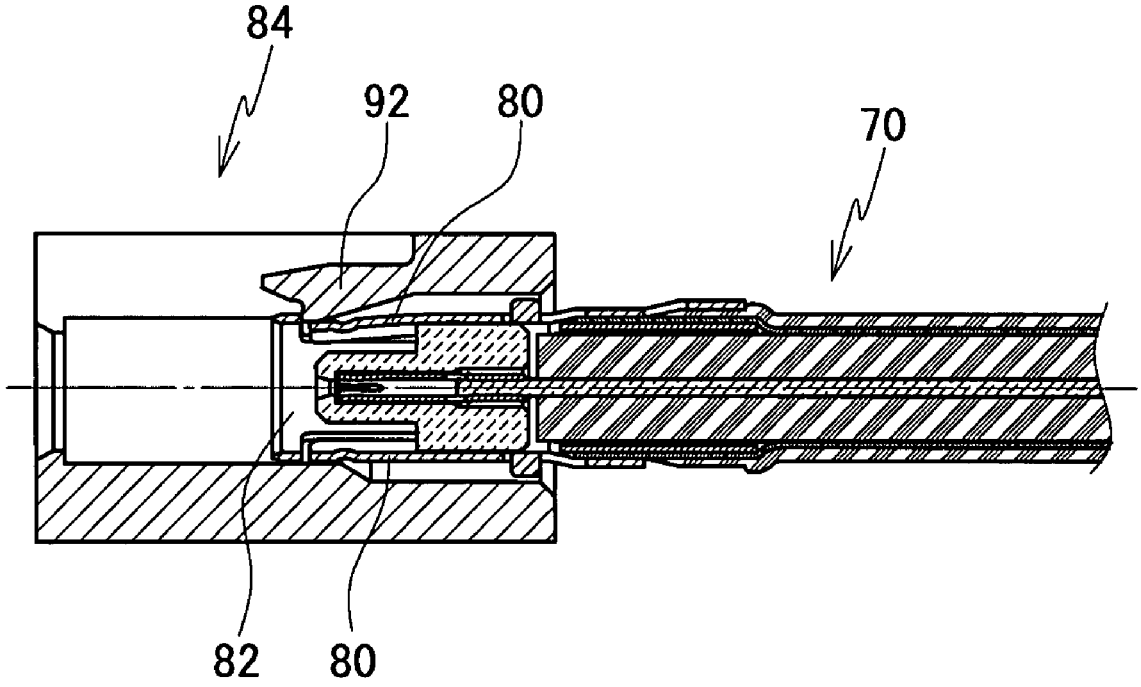
FIG. 15 is a view showing a state in which the coaxial connector shown in FIGS. 11A and 11B is in the process of being inserted into the connector housing shown in FIG. 12.

In addition, when it is intended that the stabilizers 76 have their insertion orientation controlled in a smaller-diameter portion 88 of the cavity 86, the size of the connector housing is not increased since the insertion orientation is not controlled in the larger-diameter portion 90. However, it is necessary to attempt to insert the stabilizers 76 into the slits which are in the back portion of the cavity 86 and not directly visible since the insertion orientation is not controlled in the entrance portion 90 of the cavity 86 as shown in FIG. 14C. Therefore, inserting workability is deteriorated. As a result, the insertion orientation becomes improper in some cases, and there are caused such defects that a locking piece 92 is caught onto spring pieces 80 of an outer conductor terminal 70 so as to break the spring pieces 80 as shown in FIG. 15, and that the locking piece 92 is caught by and cannot be released from a protective portion 82 arranged to protect the spring pieces 80.

In contrast, the configuration shown in FIG. 5 is such that the stabilizers 16 can be controlled by providing the slit 52 from the entrance of the cavity 48, and that the size of the connector housing 46 is not increased even if the slit 52 is provided thereto. Such a configuration is especially effective for a multi-contact connector housing such that a plurality of coaxial connectors are inserted into the connector housing, and an increase in the pitch between terminals can be prevented by such a configuration.

At the time of the insertion of the coaxial connector 10 into the connector housing 46, the locking piece 50 is taken in by the opening portion while rubbing against an outer surface of the outer conductor terminal 12. If the fitting portion 18 has unevenness even if only slightly, the locking piece 50 is chipped off and worn when the locking piece 50 slides over such a portion. However, since the fitting portion 18 and the opening portion 14 are placed at different positions, the locking piece 50 does not slide over the fitting portion 18 and the locking piece 50 is not chipped off.

Figure 11A:
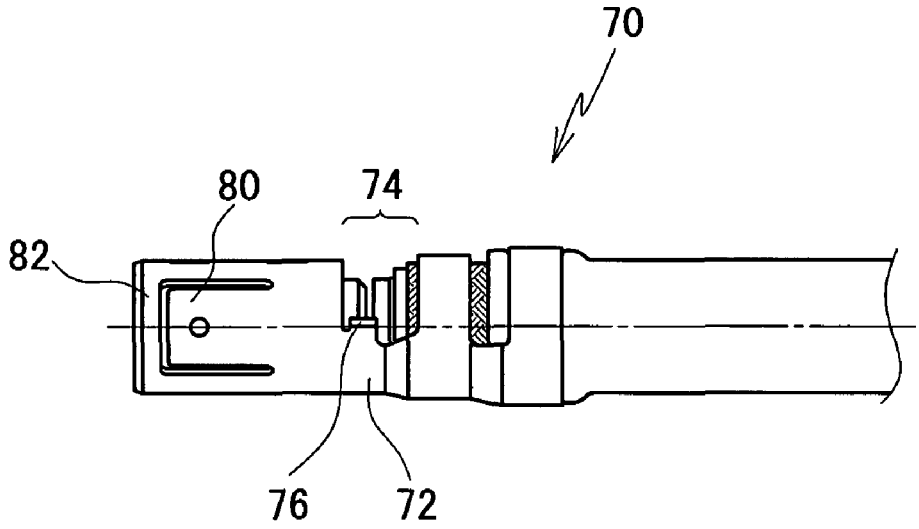
FIGS. 11A and 11B are views showing a structure of a conventional coaxial connector.
Figure 11B:
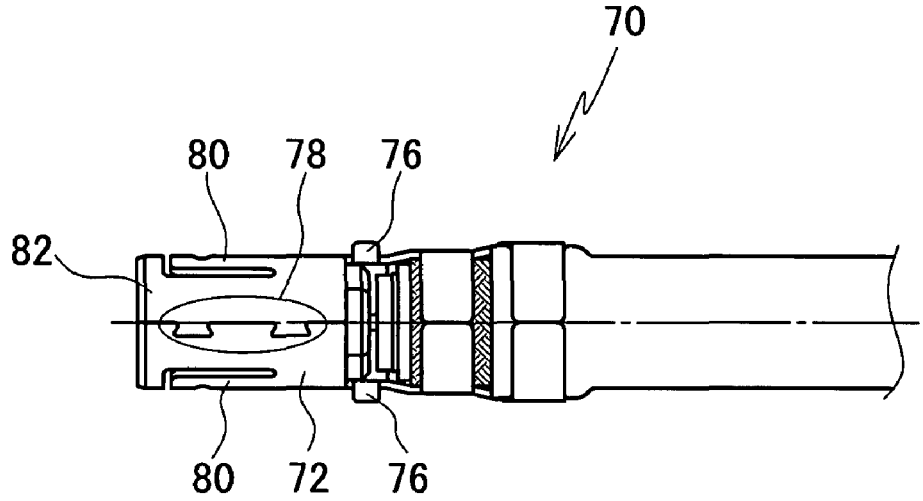
Figure 13A:
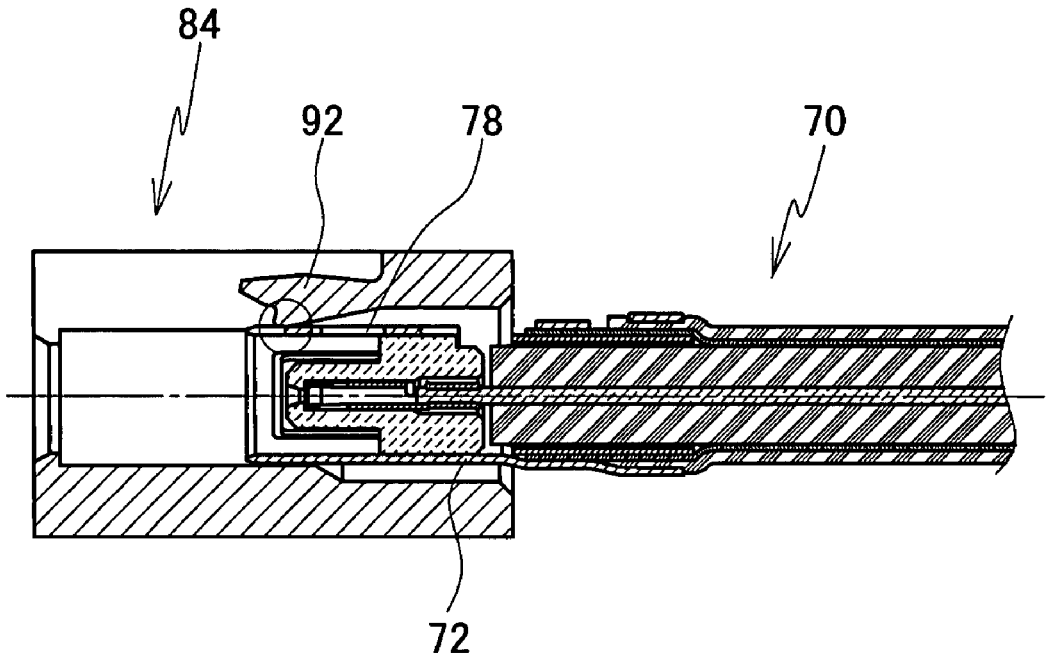
FIGS. 13A and 13B are views showing a state in which the coaxial connector shown in FIGS. 11A and 11B is in the process of being inserted into the connector housing shown in FIG. 12.
Figure 13B:
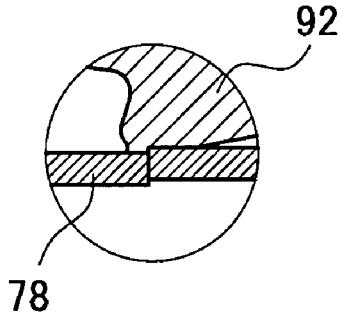

In contrast, as shown in FIG. 11B, the conventional coaxial connector 70 is arranged such that an opening portion 74 is placed on the same plane as a fitting portion 78. Therefore, as shown in FIG. 13A, when the coaxial connector 70 is inserted into the connector housing 84, the locking piece 92 of the connector housing 84 slides over the fitting portion 78 of the outer conductor terminal 72 of the coaxial connector 70, so that if the fitting portion 78 has unevenness even if only slightly, the locking piece 92 is worn and broken by repeating insertion and removal of the coaxial connector 70, and there is a possibility that a force of the connector housing 84 to hold the coaxial connector 70 could not be maintained.

Figure 6:
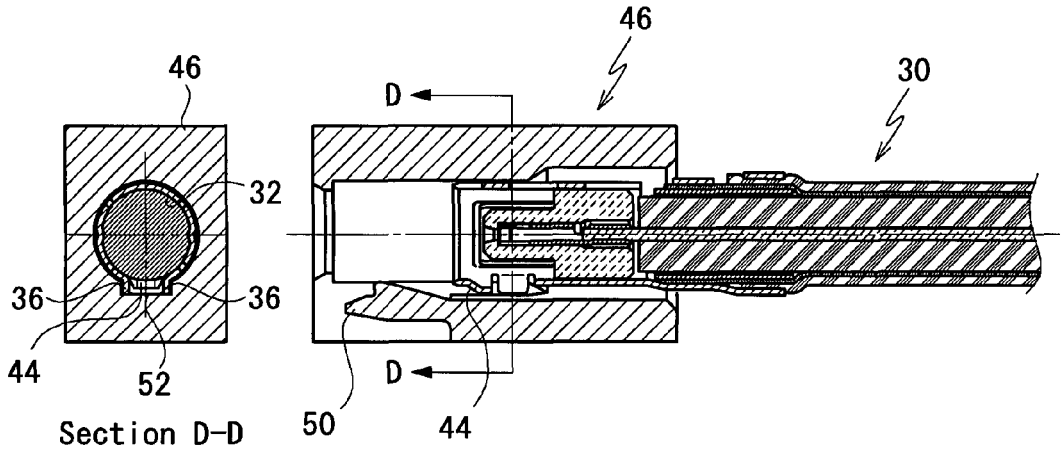
FIG. 6 is a view showing a state in which the coaxial connector shown in FIGS. 2A to 2C is in the process of being inserted into the connector housing shown in FIGS. 3A and 3B.

FIG. 6 is a view showing a state in which the coaxial connector 30 is in the process of being inserted into and attached to the connector housing 46, and a cross-sectional view in D-D section of FIG. 6 shows a positional relationship between the stabilizers 36 and the engaging piece 44 at the time when the stabilizers 36 pass through the slit 52. The engaging piece 44 is placed between the two stabilizers 36 and on the top end side relative to the stabilizers 36. Accordingly, the engaging piece 44 functions as such a guide plane that facilitates the insertion of the stabilizers 36 of the coaxial connector 30 into the slit 52 of the connector housing 46.

Figure 7:
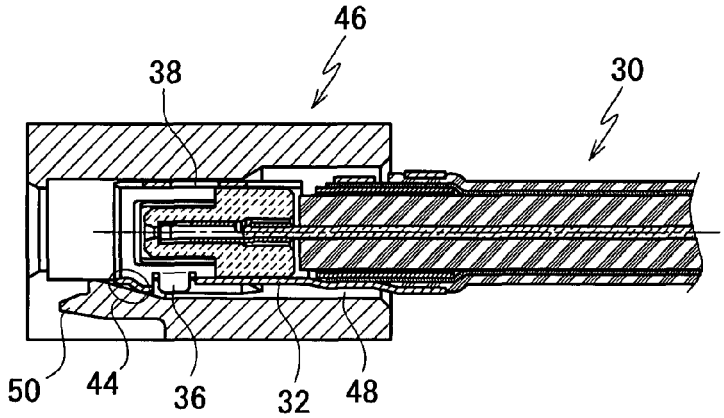
FIG. 7 is a view showing a state in which the coaxial connector shown in FIGS. 2A to 2C is in the process of being inserted into the connector housing shown in FIGS. 3A and 3B.

Similar to FIG. 6, FIG. 7 shows a state in which the coaxial connector 30 is in the process of being inserted into and attached to the connector housing 46, which specifically shows a state in which a top end of the coaxial connector 30 reaches the locking piece 50 and the engaging piece 44 is caught onto the locking piece 50. In this state, there is a possibility that the locking piece 50 makes contact with the engaging piece 44 and is chipped off by the engaging piece 44 when the engaging piece 44 is caught onto the locking piece 50. However, since the outer surface of the engaging piece 44, i.e., a surface to be brought into contact with the locking piece 50 has the curved plane so as to be smooth, the locking piece 50 can be prevented from being chipped off at the time of the contact.

Next, a description of a state when a male coaxial connector is mated and connected to a female connector attached to a connector housing will be given.

Figure 8:
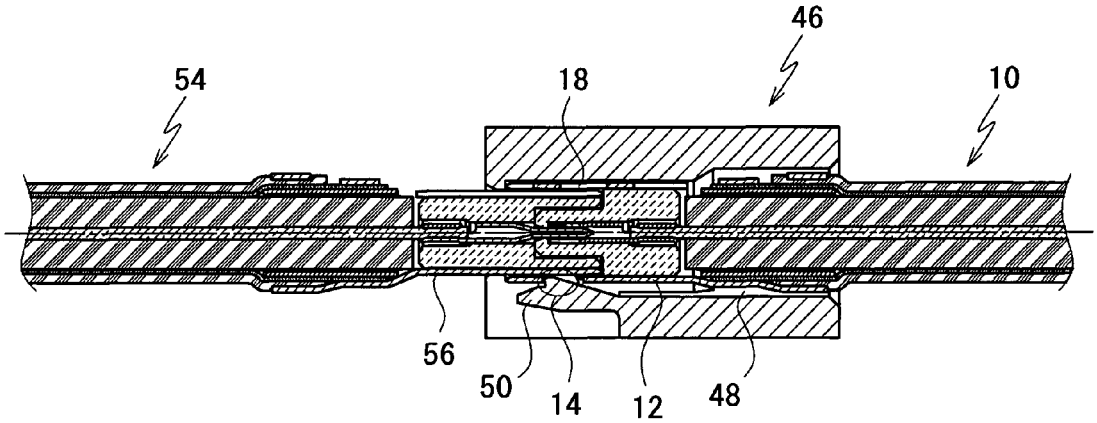
FIG. 8 is a view showing a state in which the female coaxial connector shown in FIG. 5 is mated to a male coaxial connector.

FIG. 8 is a view showing a state in which a second (male) coaxial connector 54 is mated to and electrically conducted and connected to the first (female) coaxial connector 10 attached to the connector housing 46. As illustrated, the female coaxial connector 10 is inserted into the cavity 48 of the connector housing 46, and the locking piece 50 of the connector housing 46 is taken in by the opening portion 14 of the outer conductor terminal 12 of the female coaxial connector 10, so that the female coaxial connector 10 is fixed to the connector housing 46.

An outer conductor terminal 56 of the male coaxial connector 54 is inserted into the outer conductor terminal 12 of the female coaxial connector 10, so that inner conductor terminals of the female and male coaxial connectors are electrically conducted and connected, and outer conductor terminals of the female and male coaxial connectors are electrically conducted and connected. In this case, the opening portion 14 of the outer conductor terminal 12 of the female coaxial connector 10 is closed by a main section of the outer conductor terminal 56 of the male coaxial connector 54 by mating the outer conductor terminals 12 and 56 of the female and male coaxial connectors 10 and 54, therefore, shielding performance of the outer conductor terminal 12 of the female coaxial connector 10 is not lowered.

Figure 9:
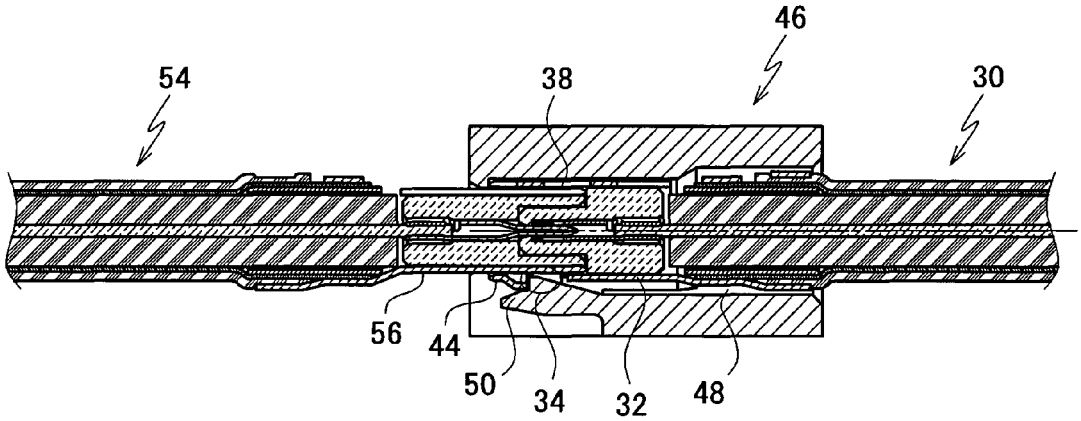
FIG. 9 is a view showing a state in which the coaxial connector shown in FIGS. 2A to 2C is attached to the connector housing shown in FIGS. 3A and 3B, and the female coaxial connector is mated to the male coaxial connector.

FIG. 9 is a view showing a state in which the second (male) coaxial connector 54 is mated to and electrically conducted and connected to the first (female) coaxial connector 30 attached to the connector housing 46. As illustrated, the female coaxial connector 30 is inserted into the cavity 48 of the connector housing 46, and the locking piece 50 of the connector housing 46 is taken in by the opening portion 34 of the outer conductor terminal 32 of the female coaxial connector 30, so that the female coaxial connector 30 is fixed to the connector housing 46.

Since the engaging piece 44 included in this embodiment functions as a locking projection arranged to lock the locking piece 50 which is locked by the opening portion 34, a force of the connector housing 46 to lock and hold the female coaxial connector 30 can be increased. By the insertion of the outer conductor terminal 56 of the male coaxial connector 54 into the outer conductor terminal 32 of the female coaxial connector 30, inner conductor terminals of the female and male coaxial conductors are electrically conducted and connected, and outer conductor terminals of the female and male coaxial conductors are electrically conducted and connected. Since the opening portion 34 of the outer conductor terminal 32 of the female coaxial connector 30 is closed by mating the outer conductor terminals 32 and 56 of the female and male coaxial connectors 30 and 54, a coaxial structure of the outer conductor terminal 32 of the female coaxial connector 30 is maintained, so that shielding performance is not lowered.

The foregoing description of the preferred embodiments of the invention is not intended to be exhaustive or to limit the invention to the precise form disclosed, and modifications and variations are possible in the light of the above teachings or may be acquired from practice of the invention.

In the preferred embodiments described above, the opening portions 14 and 34, the stabilizers 16 and 36, and the engaging piece 44 of the outer conductor terminals 12 and 32 of the coaxial connectors 10 and 30, and the locking piece 50 and the slit 52 of the connector housing 46 are positioned at the bottom sections in the drawings, however, the positions to place them are not limited thereto since it is enough if the locking piece is locked by the opening portion or the engaging piece of the outer conductor terminal and if the insertion orientation of the coaxial connector is controlled by the insertion of the stabilizers into the slit. In addition, the coaxial connectors in the drawings have a circular shape in cross section, however, they may have a rectangular shape in cross section.

INDUSTRIAL APPLICABILITY

The coaxial connector according to the present invention may be used in a connector of a coaxial cable which is routed through electric or other equipment to be mounted inside an automobile and for other applications.

The invention claimed is:

1. A structure for attaching a coaxial connector to a connector housing, in which an outer conductor terminal of a first coaxial connector is connected to a top end of a coaxial cable, an outer conductor terminal of a second coaxial connector is connected to a top end of a coaxial cable, and the outer conductor terminals are mated in a connector housing, wherein an opening portion provided on an outer surface at a main section of the outer conductor terminal of the first coaxial connector and arranged to lock a locking piece of the connector housing is closed by a main section of the outer conductor terminal of the second coaxial connector.

2. The structure for attaching the coaxial connector to the connector housing according to claim 1, the first coaxial connector further comprising:

a fitting portion provided at the main section of the outer conductor terminal of the first coaxial connector by bending a metal plate to have a cylindrical shape and butting and fitting edges of the metal plate, wherein the opening portion arranged to lock the locking piece is placed at a position different from that of the fitting portion.

3. The structure for attaching the coaxial connector to the connector housing according to claim 2, the first coaxial connector further comprising:

an engaging piece provided at an edge of the opening portion provided at the main section of the outer conductor terminal of the first coaxial connector, formed so as to project outward from the peripheral surface at the main section of the outer conductor terminal of the first coaxial connector, and arranged to engage with the locking piece of the connector housing.

4. A coaxial connector comprising:

a coaxial cable;

an outer conductor terminal connected to a top end of the coaxial cable;

a stabilizer formed by cutting and erecting a peripheral surface at a main section of the outer conductor terminal, on which section an outer conductor terminal of a counterpart coaxial connector is positioned, and arranged to control an insertion orientation of the coaxial connector into a slit of a connector housing used to house the coaxial connector; and an opening portion made by forming the stabilizer, wherein the opening portion is used as an opening portion arranged to lock a locking piece of the connector housing.

5. The coaxial connector according to claim 4, further comprising:

an engaging piece provided at an edge of the opening portion made by forming the stabilizer, formed so as to project outward from the peripheral surface at the main section of the outer conductor terminal, and arranged to engage with the locking piece of the connector housing.

6. The coaxial connector according to claim 4, further comprising:

a guide piece provided at the edge of the opening portion made by forming the stabilizer, formed so as to project outward from the peripheral surface at the main section of the outer conductor terminal, and arranged to function as a guide plane when the stabilizer is inserted into the slit of the connector housing.

7. The coaxial connector according to claim 4, wherein a guide piece arranged to function as a guide plane when the stabilizer is inserted into the slit is used as an engaging piece arranged to engage with the locking piece of the connector housing.

8. The coaxial connector according to claim 5, further comprising:

a guide piece provided at the edge of the opening portion made by forming the stabilizer, formed so as to project outward from the peripheral surface at the main section of the outer conductor terminal, and arranged to function as a guide plane when the stabilizer is inserted into the slit of the connector housing.

9. The coaxial connector according to claim 5, wherein a guide piece arranged to function as a guide plane when the stabilizer is inserted into the slit is used as the engaging piece arranged to engage with the locking piece of the connector housing.

10. The coaxial connector according to claim 6, wherein the guide piece arranged to function as the guide plane when the stabilizer is inserted into the slit is used as an engaging piece arranged to engage with the locking piece of the connector housing.

* * * * *